US006695224B2

(12) United States Patent
Hunter

(10) Patent No.: US 6,695,224 B2
(45) **Date of Patent: *Feb. 24, 2004**

(54) SPRAY NOZZLE FOR A TWO-COMPONENT AIR-ASSISTED, LOW PRESSURE SPRAY SYSTEM

(75) Inventor: Jack H. Hunter, Moon Township, PA (US)

(73) Assignee: Bayer Polymers LLC, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/838,792

(22) Filed: Apr. 20, 2001

(65) Prior Publication Data

US 2002/0153433 A1 Oct. 24, 2002

(51) Int. Cl.[7] ..... B05B 1/28; B05B 7/26; A62C 31/00

(52) U.S. Cl. ..... 239/290; 239/398; 239/303; 239/314; 239/600

(58) Field of Search ..... 239/398, 397, 239/290, 302, 303, 306, 314, 370, 525, 526, 527, 418, 419.5, 600, 119, 8

(56) References Cited

U.S. PATENT DOCUMENTS 4,967,956 A * 11/1990 Mansfield ..... 239/9
5,069,881 A 12/1991 Clarkin ..... 422/135

(List continued on next page.)

FOREIGN PATENT DOCUMENTS

DE 196 45 614 5/1998
DE 296 23 922 9/2000

OTHER PUBLICATIONS

Adhesive Systems Technology Corporation, Metering & Dispensing Equipment For the Professional Contractor, date unavailable.
130 Series, Spiral™ Mixer Sanitary design, date unavailable.
TAH Industries, Inc. Catalog 110, May 2000, Motionless Mixers for Adhesives and Sealants pp. 3–16.

*Primary Examiner*—Davis Hwu
(74) *Attorney, Agent, or Firm*—Joseph C. Gil; Thomas W. Roy; Gary F. Matz

(57) ABSTRACT

The present invention relates to a spray nozzle for a two-component, air-assisted, low pressure spray system including 1) a static mixer having an upstream end and a downstream end wherein
   a) the upstream end has an inlet port for receiving a first liquid component and a second liquid component that is reactive with the first liquid component and the upstream end is dimensioned to be reversibly connected to a dispensing unit for the first and second liquid components, and
   b) the downstream end has an optionally removable spray tip for introducing the mixed liquid components into an atomizing zone and the downstream end is dimensioned for reversibly connecting the static mixer to a spray section, and
2) a spray section having an upstream end and a downstream end wherein
   a) the upstream end of the spray section is dimensioned for being reversibly connecting to the static mixer,
   b) the spray section has inlet ports for receiving pressurized air and
   c) the downstream end of the spray section has outlet ports for introducing air into an atomizing zone formed between the outlet ports and the spray tip, wherein the spray tip of the static mixer passes through an orifice in the spray section such that the mixed liquid components are introduced into the atomizing zone.

11 Claims, 2 Drawing Sheets

U.S. PATENT DOCUMENTS 5,178,326 A * 1/1993 Kukesh et al. ..... 239/8
5,379,939 A * 1/1995 Perret, Jr. ..... 239/119
5,405,083 A * 4/1995 Moses ..... 239/9
5,820,025 A * 10/1998 Troudt ..... 239/119
6,062,492 A 5/2000 Tudor et al. ..... 239/296
6,394,644 B1 * 5/2002 Streiff ..... 366/337
6,488,991 B1 * 12/2002 Hunter et al. ..... 427/421

* cited by examiner 1
2
3
4
5
6
7
8
9
10
11
12
13
14
15
17
18
19
20
21

SPRAY NOZZLE FOR A TWO-COMPONENT AIR-ASSISTED, LOW PRESSURE SPRAY SYSTEM

BACKGROUND OF THE INVENTION

1. Field of the Invention

The present invention relates to an improved spray nozzle for a two-component, air-assisted, low pressure spray system, which is especially suited for applying highly reactive, two-component coating or sealing compositions, preferably two-component polyurea coating compositions.

2. Description of the Prior Art

Several types of spray systems are known for applying two-component coating compositions. If the two components are not highly reactive, it is possible to mix the two components prior to use and apply the systems with known one-component, airless or air-assisted spray systems. These systems are generally used with coating compositions having a pot life of one hour to several hours.

Preferably, the two-component compositions are applied with two-component spray systems, which may be either high pressure (more than 100 bar) or low pressure (less than 100 bar) systems. The high pressure systems are usually airless or air-assisted airless spray systems. In these systems the two components are generally introduced under high pressure into a static mixer and are then passed through a spray tip under sufficient pressure to atomize the liquid. One disadvantage of these systems is their high cost.

Also suitable are low pressure or high pressure impingement mixers in which the components are introduced through separate orifices into a mixing chamber and then pass through an atomization spray tip under fluid pressure. The mixing chamber is generally purged with a purge rod or pressurized air. Disadvantages of impingement mixing systems are their cost, difficulty to use and typical high pressure requirements.

Examples of low pressure systems for applying two-component compositions are air-assisted sprayers in which the components are premixed and then siphoned or passed by gravity through an air atomization tip. Air is passed in a generally perpendicular manner to the mixed composition from opposing outlets to atomize the composition into the desired spray pattern. A disadvantage of these spray systems is that they are not suitable for spraying highly reactive two-component systems. Both during the spraying process and especially during stoppages, the components can react to form polymer solids that clog both the liquid spray tips and/or the air outlets. This causes a lengthy down time to clean the equipment for further use.

One alternative to prevent clogging in any of these low or high pressure sprayers is to flush the equipment with a solvent or an air purge prior to stoppages. However, this embodiment results in higher equipment costs due to the presence of a third stream. In addition, the use of a solvent is disadvantageous both from a cost standpoint and an environmental standpoint.

It is an object of the present invention to overcome the disadvantages of prior art spray systems in a cost effective manner.

This object may be achieved with the low pressure, two-component, air-assisted spray system according to the present invention. An important feature of the invention is the use of a disposable static mixer having an optionally removable spray tip to eliminate the clogging problems of prior art systems when spraying highly reactive two-component systems.

Copending application, U.S. Ser. No. 09/838,794, describes a static mixer having an optionally removable spray tip, but in that application the static mixer is inserted into a shroud. U.S. Ser. Nos. 09/917,309 and 09/917,298 also describe static mixers having optionally removable spray tips, but these applications require the static mixers to be used in combination with caulking guns.

SUMMARY OF THE INVENTION

The present invention relates to a spray nozzle for a two-component, air-assisted, low pressure spray system including 1) a static mixer having an upstream end and a downstream end wherein
   a) the upstream end has an inlet port for receiving a first liquid component and a second liquid component that is reactive with the first liquid component and the upstream end is dimensioned to be reversibly connected to a dispensing unit for the first and second liquid components, and
   b) the downstream end has an optionally removable spray tip for introducing the mixed liquid components into an atomizing zone and the downstream end is dimensioned for reversibly connecting the static mixer to a spray section, and
2) a spray section having an upstream end and a downstream end wherein
   a) the upstream end of the spray section is dimensioned for being reversibly connecting to the static mixer,
   b) the spray section has inlet ports for receiving pressurized air and
   c) the downstream end of the spray section has outlet ports for introducing air into an atomizing zone formed between the outlet ports and the spray tip, wherein the spray tip of the static mixer passes through an orifice in the spray section such that the mixed liquid components are introduced into the atomizing zone.

The present invention also relates to a process for spraying a two-component composition by a) introducing a first liquid component and a second inlet component, which is reactive with the first liquid component, into a static mixer having an optionally removable spray tip,
b) mixing the first component with the second component in the static mixer,
c) discharging the mixed liquid components from the static mixer through the optionally removable spray tip at the downstream end of the static mixer into an atomizing zone,
d) introducing air into the atomizing zone,
e) atomizing the mixed liquid components in the atomizing zone,
f) spraying the atomized liquid components onto a substrate and
g) during an interruption in the spraying process or after termination of the spraying process, discarding the static mixer and the optionally removable spray tip.

DETAILED DESCRIPTION OF THE INVENTION

In accordance with the present invention it is possible to overcome the problem of clogging in the static mixer, the spray tip and/or air entry ports when spraying highly reactive, two-component compositions. This is accomplished by using a removable static mixer having an optionally removable spray tip at the downstream end. In one embodiment the static mixer tapers at the downstream end to form a spray tip. In a preferred embodiment a removable spray tip is attached to the downstream end of the static mixer. In accordance with this preferred embodiment different size spray tips can be attached to control the volume of material to be sprayed.

The static mixers can be made of metal or plastic or other suitable materials. They are preferably made from plastic for cost reasons because at the completion of the spraying process or during periods when the spraying process is interrupted, the static mixer and the optionally removable spray tip are removed and discarded. However, the pressure limitations of the static mixers should not be exceeded. Accordingly, when operating at higher pressures, it may be necessary to use metal or other specially designed static mixers that can withstand the operating pressure.

Examples of suitable static mixers are available as motionless mixers from Tah Industries. Examples include stainless tube mixers, stainless pipe mixers, stainless/plastic pipe mixers and plastic tube mixers. Removable spray tips are also available from Tah Industries as Luer lock fitting needles.

In accordance with the present invention the upstream end of the static mixer is dimensioned to be reversibly connected to a dispensing unit for the first and second liquid components and the downsteam end of the static mixer is dimensioned to be reversibly connected to the spray section. The type of connection is not critical, provided that the connection is reversible so that the static mixer and the optionally removable spray tip can be discarded. Suitable connections include threads, clamps, retaining rings and quick connectors.

Figures 1, 2:
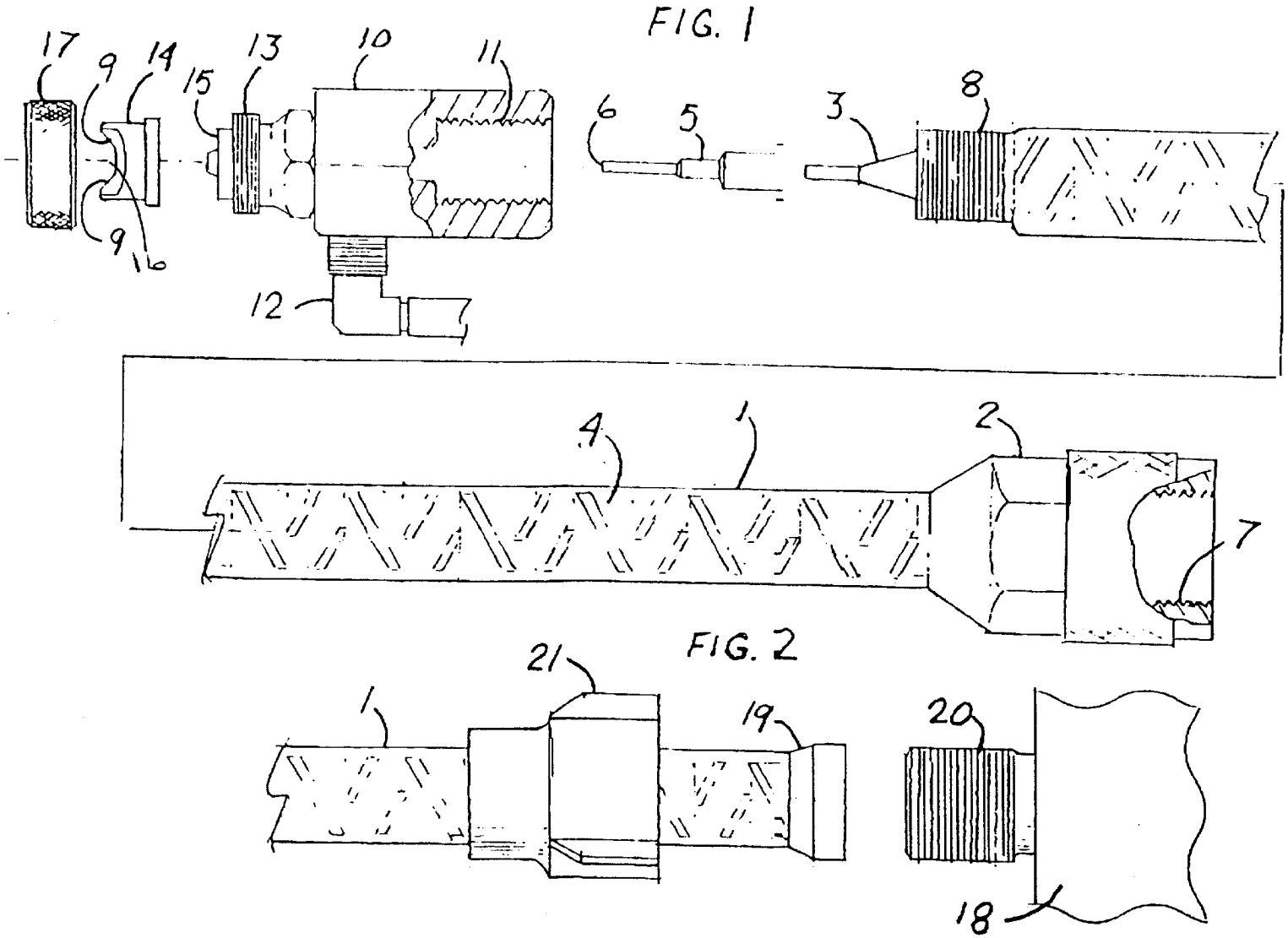
FIG. 1 represents an exploded view of a preferred embodiment of the spray nozzle according to the invention.
FIG. 2 represents another embodiment of the static mixer according to the invention.

In one embodiment, which is shown in FIG. 1, the upstream end of the static mixer is threaded so that it can be attached to the threaded end of the dispensing unit. In another embodiment, which is shown in FIG. 2, the upstream end of the static mixer is flared so that it can be held against the dispensing unit by a retaining ring, preferably a threaded retaining ring.

The upstream end of a conventional spray section having an atomizing zone is connected to the downstream end of the static mixer. Both ends are dimensioned to be reversibly connected to each other. This connection can be the same as those set forth previously for connecting the upstream end of the static mixer to the dispensing unit. The spray tip extends through an orifice in the rear portion of the spray section and into the atomizing zone.

After the components are mixed in the static mixer they are introduced into the atomizing zone of the spray section where the mixed components are atomized with air, which may compressed in known manner in a compressor. Methods of atomizing the liquid components with air for spraying are well known and are not critical to the present invention.

Figure 4:
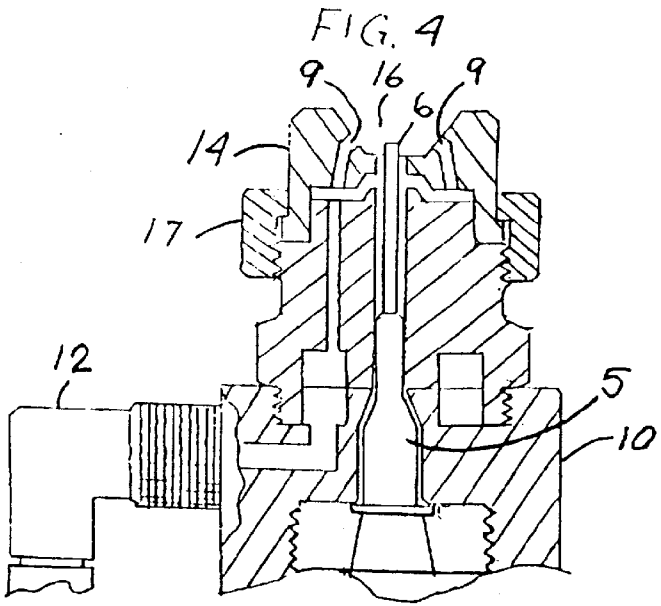
FIG. 4 represents an enlarged view of the spray section of the spray nozzle.

In a preferred embodiment as shown in FIG. 4, the mixed liquid components are passed generally perpendicularly past two or more opposed air outlet ports. Depending upon the arrangement of these ports to the mixed components a flat or conical spray pattern can be controlled in known manner.

Air may also be introduced through the same orifice in the spray section that the spray tip passes through. In this embodiment the air passes on the outside of the spray tip parallel to the mixed components. However, less atomization occurs according to this embodiment. It is also possible to introduce air at other angles to the liquid components that range from parallel to perpendicular or slightly greater.

The method of introducing reactive first and second components into the static mixer is not critical and does not form a part of the spray nozzle according to the present invention. Any apparatus that is known for accurately metering plural components is suitable for use as the delivery means. Suitable apparatus is available from Adhesive Systems Technology (AST) Corporation as metering and dispensing equipment for plural component reactive systems. The upstream end of the shroud is dimensioned to be reversibly connected to the plural component dispensing unit of the metering and dispensing equipment.

In accordance with the process of the present invention the first and second liquid components are preferably introduced into the static mixer at a pressure of 5 to 100 bar, more preferably 10 to 100 and most preferably 30 to 70 bar, which is supplied by the dispensing equipment. The components are then mixed in the static mixer and discharged through the optionally removable spray tip at the downstream end of the static mixer into an atomizing zone. Air is also introduced into the atomizing zone at a pressure of preferably 0.5 to 10 bar, preferably 1 to 7 bar and more preferably 3 to 6 bar. The atomized liquid components are then applied to a suitable substrate.

Suitable first and second components include any compounds that are reactive with each other to form a polymer. Examples include the reaction of polyisocyanates with polyols to form polyurethanes, the reaction of polyisocyanates with polyamines to form polyureas and the reaction of epoxy resins or epoxidized urethanes with amine curatives to form polyamides. Examples of suitable components are well known. Preferred components are those that are highly reactive with each other, e.g. those that cure or react with each other within a few minutes to a few seconds. When spraying these types of components any interruption of the spraying operation results in clogging of the static mixer, especially the spray tip and occasionally the air inlets to the atomizing zone.

An example of highly reactive components are the polyisocyanates and polyaspartates described in U.S. Pat. Nos. 5,126,170 and 5,236,741, which are herein incorporated by reference.

FIG. 1 represents a preferred embodiment of the present invention. Static mixer 1 has threaded end 2 for receiving the two-component composition and tapered end 3 for receiving removable spray tip 5. Static mixer 1 has internal mixing unit 4 for homogeneously mixing the two-component composition. Spray tip 5 has an end 6.

Static mixer 1 and spray tip 5 are inserted through spray section 10 such that end 6 extends into atomizing zone 16. Static mixer 1 has threaded end 7 for attaching to a dispensing unit for the two-component composition and threaded end 8 for connecting to spray section 10. Air is introduced into atomizing zone 16 via tube 12 through outlet ports in modified fluid nozzle 15 and through outlet ports 9 in air cap

14. Air cap 14 is held against the modified fluid nozzle 15 by attaching threaded retaining ring 17 to threads 13 of spray section 10. In atomizing zone 16, the air passing through outlet ports 9 atomizes the liquid stream of the two-component coating composition passing through static mixer 1 and end 6 of spray tip 5.

FIG. 2 shows an alternative embodiment in which static mixer 1 has a flared end 19 which is held against threaded end 20 of dispensing unit 18 for the two-component composition by retaining ring 21.

Figure 3:
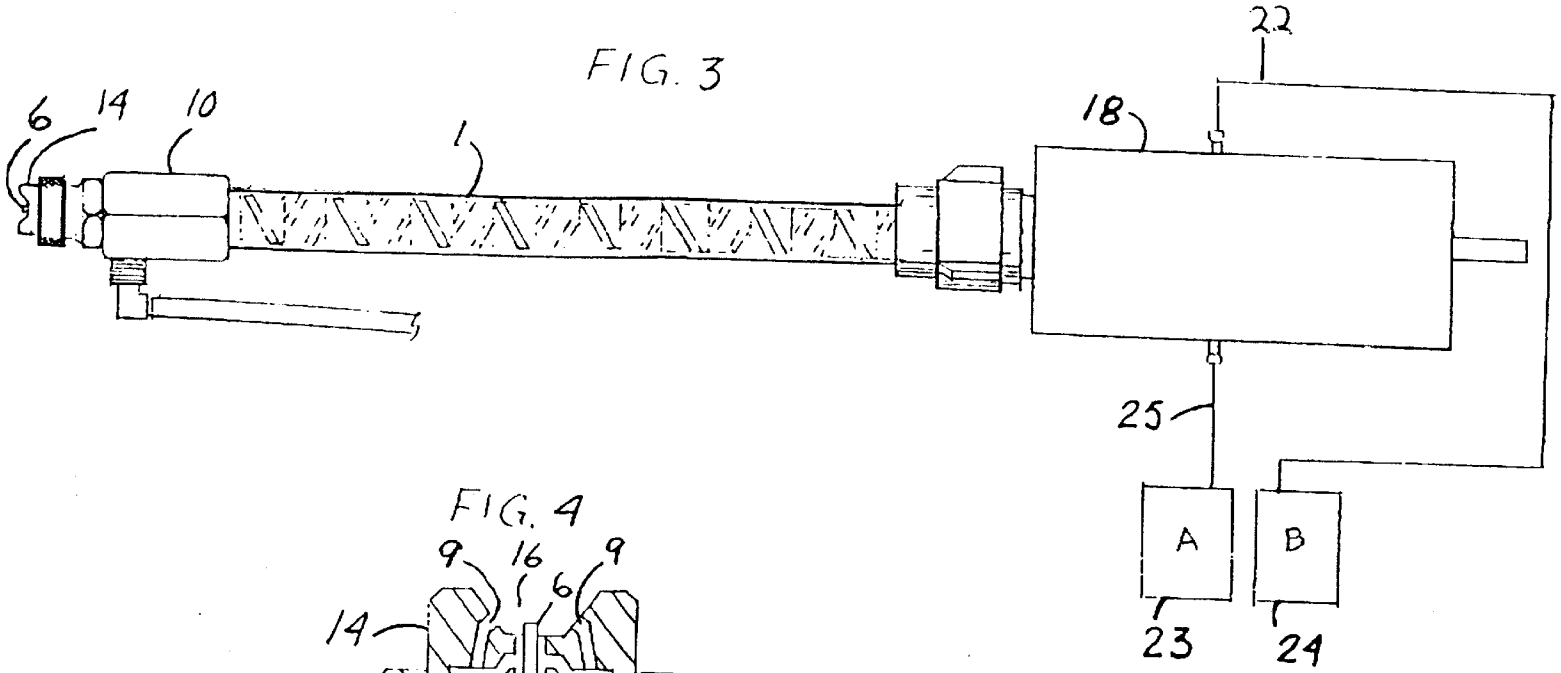
FIG. 3 represents an embodiment of the spray nozzle connected to the component storage and dispensing unit.

FIG. 3 shows a preferred embodiment of the spray nozzle according to the invention that has been connected to a dispensing unit for the two-component composition. Components A and B pass from storage containers 23 and 24 under pressure through lines 25 and 22 into dispensing unit 18 and then into static mixer 1. Threaded end 20 of dispensing unit 18 is attached to threaded end 7 of static mixer 1. Components A and B are mixed in static mixer 1 and then pass through spray tip 5 and end 6 into the atomizing zone. The narrowed end 6 of spray tip 5 extends beyond the base of air cap 14.

FIG. 4 shows an enlargement of a preferred embodiment of spray section 10. Spray tip 5 extends through spray section 10 such that end 6 passes through an orifice in air cap 14, which is held onto the end of spray section 10 by retaining ring 17. Air enters the upper portion of spray section 10 through tube 12 and passes through outlet ports in modified fluid nozzle 15 and through outlet ports 9 in air cap 14 into atomizing zone 16.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A spray nozzle for a two-component, air-assisted, low pressure spray system comprising 1) a static mixer having an upstream end and a downstream end wherein
   a) the upstream end has an inlet port for receiving a first liquid component and a second liquid component that is reactive with the first liquid component and the upstream end is dimensioned to be connected and unconnected to a dispensing unit for the first and second liquid components, and
   b) the downstream end has an optionally removable spray tip for introducing the mixed liquid components into an atomizing zone and the downstream end is dimensioned for connecting and unconnecting the static mixer to a spray section, and 2) a spray section having an upstream end and a downstream end wherein
   a) the upstream end of the spray section is dimensioned for being connecting and unconnecting to the static mixer,
   b) the spray section has inlet ports for receiving pressurized air and
   c) the downstream end of the spray section has outlet ports for introducing air into an atomizing zone formed between the outlet ports and the spray tip, wherein the spray tip of the static mixer passes through an orifice in the spray section such that the mixed liquid components are introduced into the atomizing zone.

2. The spray nozzle of claim 1 wherein said spray tip is removable.

3. The spray nozzle of claim 2 wherein said static mixer is a plastic static mixer.

4. The spray nozzle of claim 3 wherein said static mixer is dimensioned to be threadably connected at its upstream end and its downstream end.

5. The spray nozzle of claim 2 wherein said static mixer is dimensioned to be threadably connected at its upstream end and its downstream end.

6. The spray nozzle of claim 1 wherein said static mixer is a plastic static mixer.

7. The spray nozzle of claim 6 wherein said static mixer is dimensioned to be threadably connected at its upstream end and its downstream end.

8. The spray nozzle of claim 1 wherein said static mixer is dimensioned to be threadably connected at its upstream end and its downstream end.

9. The spray nozzle of claim 1 wherein said static mixer tapers to form a spray tip.

10. A process for spraying a two-component composition which comprises a) introducing a first liquid component and a second liquid component, which is reactive with the first liquid component, into a static mixer having an optionally removable spray tip, b) mixing the first component with the second component in the static mixer, c) discharging the mixed liquid components from the static mixer through the optionally removable spray tip at the downstream end of the static mixer into an atomizing zone, d) introducing air into the atomizing zone, e) atomizing the mixed liquid components in the atomizing zone, f) spraying the atomized liquid components onto a substrate and g) during an interruption in the spraying process or after termination of the spraying process, discarding the static mixer and the optionally removable spray tip.

11. The process of claim 10 wherein said first component is a polyisocyanate and said second liquid component is a polyaspartate.

* * * * *